US005200288A

United States Patent [19]

Ando et al.

[11] Patent Number: 5,200,288

[45] Date of Patent: Apr. 6, 1993

[54] ELECTROSTATIC DEVELOPING TONER WITH HYDROXYAROMATIC CARBOXYLIC ACID ADDITIVE

[75] Inventors: Osamu Ando, Kawasaki; Masako Takeuchi; Hitoshi Ono, both of Yokohama; Toshiyuki Sueyoshi, Chigasaki; Shigenori Hayakawa, Hiratsuka, all of Japan

[73] Assignee: Mitsubishi Kasei Corporation, Tokyo, Japan

[21] Appl. No.: 804,981

[22] Filed: Dec. 11, 1991

[30] Foreign Application Priority Data

| | | | |
|---|---|---|---|
| Dec. 12, 1990 | [JP] | Japan | 2-401712 |
| May 9, 1991 | [JP] | Japan | 3-104383 |
| May 24, 1991 | [JP] | Japan | 3-120365 |
| Jul. 30, 1991 | [JP] | Japan | 3-190060 |

[51] Int. Cl.[5] ..... G03G 9/097

[52] U.S. Cl. ..... 430/110

[58] Field of Search ..... 430/110

[56] References Cited

U.S. PATENT DOCUMENTS

| | | | |
|---|---|---|---|
| 4,656,112 | 4/1987 | Kawagishi et al. | 430/110 |
| 4,859,559 | 8/1989 | Trout | 430/110 X |

FOREIGN PATENT DOCUMENTS

| | | | |
|---|---|---|---|
| 163061 | 7/1987 | Japan | 430/110 |

*Primary Examiner*—Roland Martin

*Attorney, Agent, or Firm*—Oblon, Spivak, McClelland, Maier & Neustadt

[57] ABSTRACT

An electrostatic image-developing toner comprising at least a resin and a colorant, which contains at least one compound selected from the group consisting of a hydroxynaphthlenecarboxylic acid compound, a hydroxyanthracenecarboxylic acid compound, a bishydroxynaphthalenecarboxylic acid compound a bishydroxyanthracenecarboxylic acid compound, and a metal compound of a pamo acid-type compound.

13 Claims, No Drawings

ELECTROSTATIC DEVELOPING TONER WITH HYDROXYAROMATIC CARBOXYLIC ACID ADDITIVE

The present invention relates to an electrostatic image-developing toner useful for e.g. electrophotographic copying machines.

As disclosed in various publications such as U.S. Pat. No. 2,297,691 and Japanese Examined Patent Publications No. 23910/1967 and No. 24748/1968, an electrophotographic method usually comprises forming an electrostatic latent image on a photoreceptor containing a photo conductive substance by various means, then developing the latent image to a powder image by means of a toner preliminarily charged by being contacted with a carrier or with the wall of the developing tank, if necessary transferring the powder image to e.g. a paper sheet, followed by fixing by heating or pressurizing, or by means of a solvent vapour. Such a toner is a powder prepared by finely pulverizing a dispersion of various dyes or pigments in a resin such as a styrene resin or an acryl resin, to a size of from 1 to 30 μm. It may be used as a two-component developer as mixed with iron powder, ferrite or magnetite having a particle size of from 30 to 200 μm, which is referred to as a carrier and which carries the toner on its surface by an electrostatic force and is to be transported to the vicinity of the photoreceptor by a magnetic force, or it may be used as a one component developer without using a carrier and in which the function of a carrier may be performed by a magnetic powder contained in the toner particles.

One of the important properties of a toner is chargeability. Namely, a toner is required to have chargeability such that it will have a positive or negative charge corresponding to the static charge of an electrostatic latent image to be developed, by the contact with a carrier or with the developing tank, and the charge is stable during a continuous use or even under an adverse environment.

The chargeability may be imparted to a toner by a binder resin or a colorant itself. However, since it is usually difficult to obtain adequate chargeability, it is common to employ, as the case requires, a method of adding a charge-imparting agent (a charge-controlling agent), such as a positively charging Nigrosine dye or quaternary ammonium salt, or a negatively charging metal-containing azo dye, metal complex of salicylic acid compound or copper phthalocyanine pigment.

However, these conventional charge-imparting agents are not necessarily adequate in the charge stability although they may have sufficiently high charge-imparting ability. Particularly, the charge tends to change with time during the continuous copying operation or continuous printing operation. If the charge increases, the image density decreases. Inversely, if the charge decreases, the toner tends to scatter, whereby contamination in the machined tends to result, and the quality of copy tends to be poor.

Further, conventional charge-imparting agents are, in most cases, of a type which contains a metal such as chromium. Although they may show high chargeability, it is desired not to use, for a toner composition, a metal like chromium which has a safety problem.

Further, in many cases, such conventional metal-containing compounds are expensive due to their complicated structures. This constitutes a factor to hinder presentation of toners at low costs.

Thus, it is desired to develop a charge-controlling agent which is inexpensive and which provides good chargeability without using a metal.

Further, in recent years, copying machines and printers have been improved for high image quality, for high speed and for modification to small sizes, whereby there have been problems such that the friction between the toner and the carrier tends to be too much, and the types or amounts of necessary additives have been changed, so that if conventional charge-imparting agents having high charging properties are employed, the charge of the toner tends to be too high that the image density tends to be low, or the charge stability tends to deteriorate.

Accordingly, it is an object of the present invention to provide a toner having a constant chargeability, whereby the level of electric charge is proper even when used in an adverse environment for a long period of time.

The present inventors have conducted extensive researches to present an electrostatic image-developing toner of a high quality whereby a constant chargeability is obtainable during the continuous copying or printing operation, the image density is constant, the image is free from stain, and an internal contamination in the machine hardly occurs. As a result, it has been found possible to solve such problems by incorporating a compound having a specific structure to a toner. The present invention has been accomplished on the basis of this discovery.

Thus, the present invention provides an electrostatic image-developing toner comprising at least a resin and a colorant, which contains at least one compound selected from the group consisting of a hydroxynaphthlenecarboxylic acid compound, a hydroxyanthracenecarboxylic acid compound, a bishydroxynaphthalenecarboxylic acid compound, a bishydroxyanthracenecarboxylic acid compound, and a metal compound of a pamo acid-type compound.

Japanese Unexamined Patent Publication No. 187769/1990 discloses a toner containing salicylic acid having a substituent; Japanese Unexamined Patent Publication No. 190869/1990 discloses a toner containing a condensation product of salicylic acid having a substituent; and Japanese Unexamined Patent Publication No. 230163/1990 discloses a toner containing a compound dimerized by using salicylic acid as a connecting group.

However, these compounds wherein salicylic acid is the aromatic component, are weak in the heat stability and apt to decompose when subjected to high temperature heat treatment in the process for producing toners. Further, their light resistance and moisture resistance are poor, and they are not suitable for toner compositions.

On the other hand, U.S. Pat. No. 4,206,064 discloses a toner containing a metal complex of salicylic acid or an alkylsalicylic acid as a negative charge-controlling agent. Further, the description of the prior art in the above-mentioned Japanese Unexamined Patent Publication No. 190869/1990 discloses the existence of a metal complex of naphthoic acid and a metal complex of a dicarboxylic acid. However, these metal complexes have a characteristic such that while the initial charge is relatively high, the charge tends to substantially change during the use for a long period of time. Thus, they do not satisfy the charge stability which is required recently more than ever, as continuous copying by a copying machine for a number of copies is required. Further, they also have a disadvantage that the chargeability of the toner tends to be so high that the image density tends to be low.

Whereas, the compound incorporated in the toner of the present invention has naphthalene or anthracene as the aromatic component and thus is excellent in the chemical stability. Further, the negative chargeability is at a level slightly less than conventional negative charge-controlling agents, but it has high charge stability such that when mixed with a carrier, the charge does not substantially change during the use for a long period of time. Further, the hydroxynaphthalenecarboxylic acid compound, the hydroxyanthracenecarboxylic acid compound, the bishydroxynaphthalenecarboxylic acid compound and the bishydroxyanthracenecarboxylic acid are slightly yellow and can therefore be incorporated to color toners of red, blue, yellow, etc.

While, the metal compound of a pamo acid-type compound to be used in the present invention, contains a metal, its chemical stability is excellent probably because the dimer compound is bonded to the metal.

Now, the present invention will be described in detail.

The hydroxynaphthalenecarboxylic acid compound or the hydroxyanthracenecarboxylic acid compound to be used for the electrostatic image-developing toner of the present invention, means naphthalene or anthracene having a hydroxyl group and a carboxyl group, or its derivative having a further substituent X, as shown by the following formula (I) or (II). Particularly preferred is the one having a hydroxyl group and a carboxyl group at the adjacent positions on the 6-membered carbon ring at its end.

The bishydroxynaphthalenecarboxylic acid compound or the bishydroxyanthracenecarboxylic acid compound means a bis compound having the same or different two molecules of said hydroxycarboxylic acid bonded by a linking group such as an alkylene chain, as shown by the following formulas (III) to (VI). The one having the same two molecules bonded is usually preferred. Further, the linking group bonding the two molecules is preferably an alkylene chain having at most 3 carbon atoms, more preferably a methylene chain.

(I)

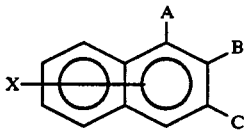

(II)

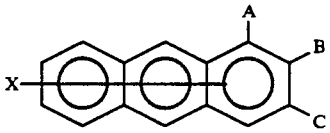

-continued (III)

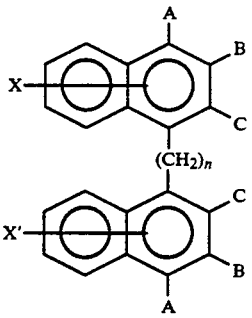

(IV)

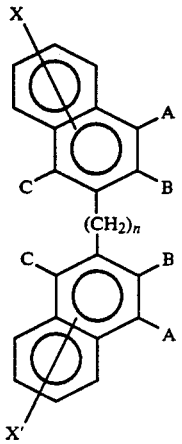

(V)

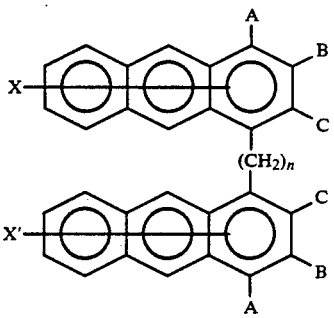

(VI)

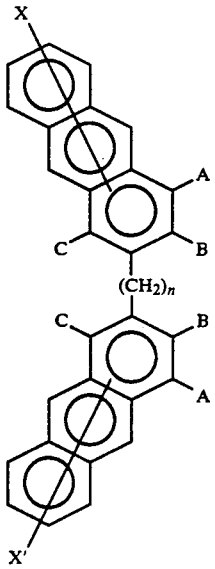

In the above formulas, at least one of substituents A, B and C is a hydroxyl group, at least one of them is a carboxyl group, and the rest is a hydrogen atom, and n is from 1 to 3.

Each of substituents X and X' may, for example, be a hydrogen atom; an alkyl group, particularly a lower alkyl group, such as a methyl group, an ethyl group, a propyl group, an isopropyl group, a n-butyl group, an isobutyl group or a tert-butyl group; an amino group; a substituted amino group such as an alkyl-substituted amino group; or an alkoxy group, particularly a lower alkoxy group, such as a methoxy group or an ethoxy group. Further, it may be an acyl group, a halogen atom, an aryl group, a hydroxyl group or a carboxyl group. Such carboxylic acid compounds may have two or more of such substituent X or X'.

Among the compounds of the above formulas (I) to (VI), preferred are the compounds of the formulas (I), (II), (III) and (V), wherein at least one hydroxyl group and a carboxyl group for A, B and C, are preferably adjacent to each other.

The bishydroxycarboxylic acid compounds can be readily prepared by a method disclosed by E. Stronback, Ber. 34, 4162 (1901). For example, such a compound can be obtained by reacting the two hydroxycarboxylic acid compounds to constitute the dimer, in a solvent such as acetic acid, by adding formaldehyde and sulfuric acid and heating them at a temperature of from 50° to 120° C.

The following compounds may be mentioned as specific preferred compounds, but is should be understood that useful compounds are not limited to such specific examples.

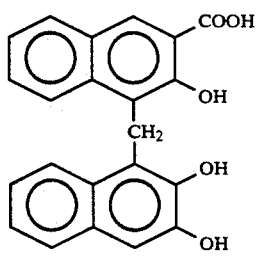

(1)

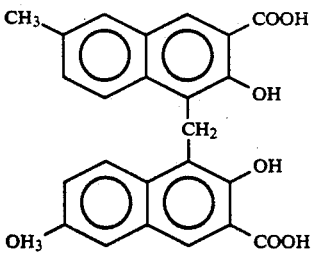

(2)

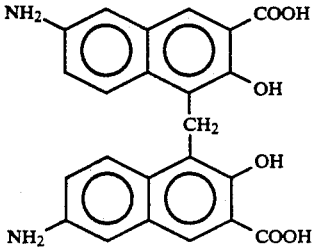

(3)

-continued

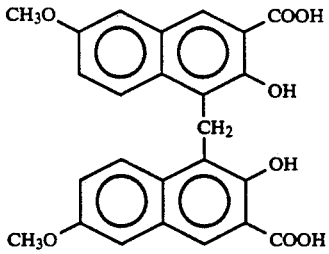

(4)

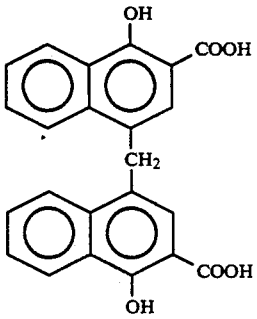

(5)

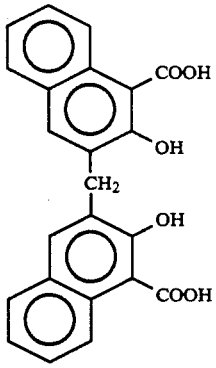

(6)

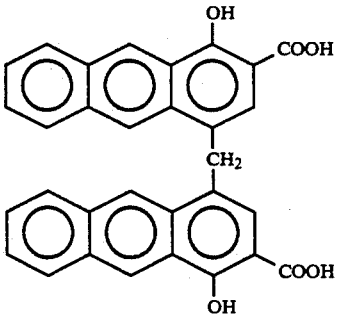

(7)

-continued
(8)
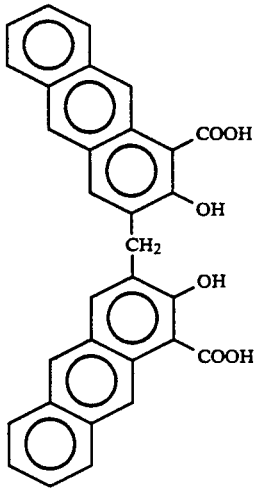
(9)
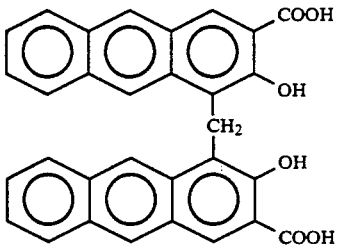
(10)
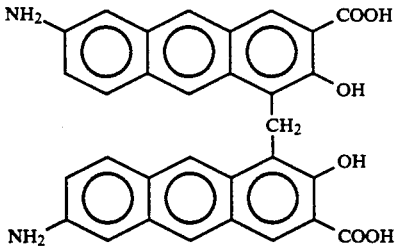
(11)
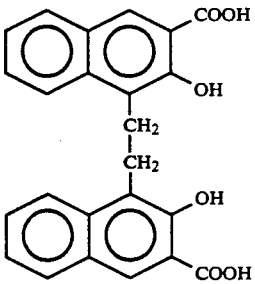
-continued
(12)
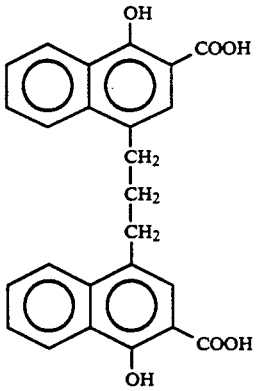
(13)
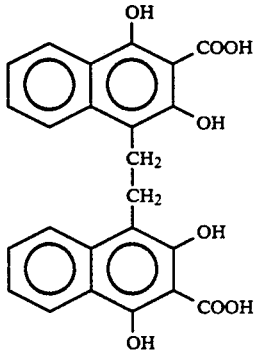
(14)
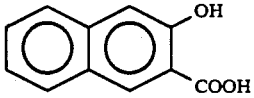
(15)
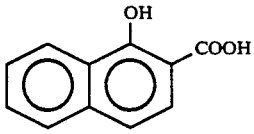
(16)
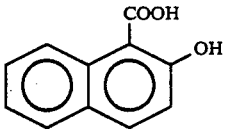
(17)
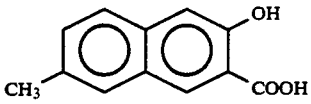
(18)
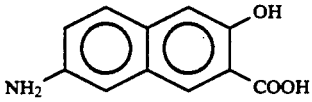
(19)
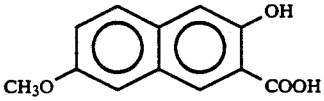
(20)
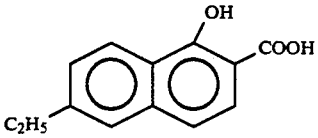

-continued (21)

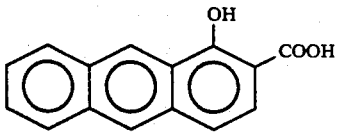

(22)

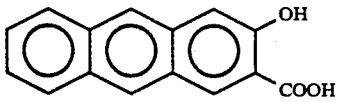

(23)

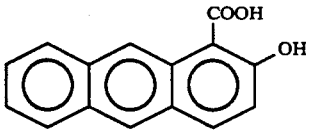

(24)

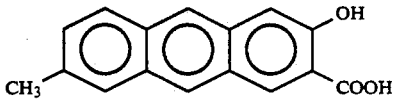

(25)

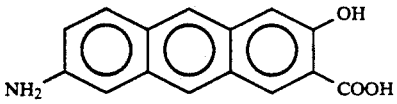

(26)

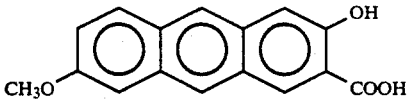

(27)

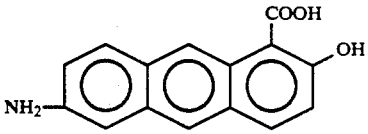

(28)

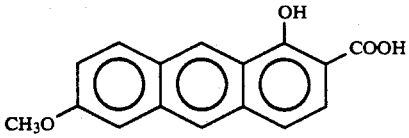

(29)

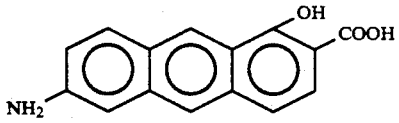

(30)

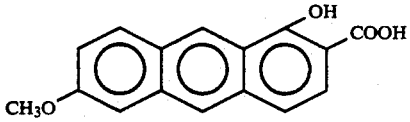

In the present invention, the pamo acid-type compound is a compound having substituted or unsubstituted hydroxynaphthalenecarboxylic acids dimerized by means of a methylene chain, as shown by the following formula (VII) or (VIII):

(VII)

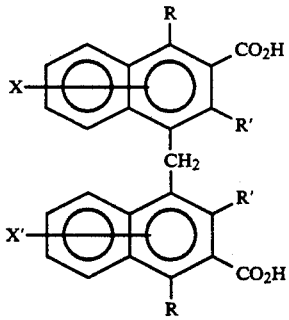

(VIII)

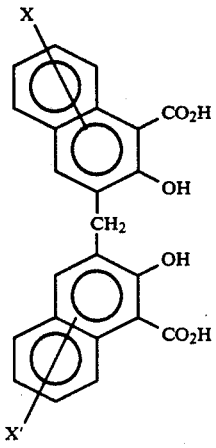

In the above formulas, one of R and R' is a hydroxyl group and the other is a hydrogen atom, and both of them are not simultaneously hydroxyl groups or hydrogen atoms.

Further, each of X and X' is an optional substituent such as a hydrogen atom, an alkyl group, an amino group or an alkoxy group. Specific examples of each of substituents X and X' include a hydrogen atom; an alkyl group such as a methyl group, an ethyl group, a propyl group, an isopropyl group, a n-butyl group, an isobutyl group or a tert-butyl group; an amino group; an alkyl-substituted amino group; and an alkoxy group such as a methoxy group or an ethoxy group.

In the present invention, the metal compound of a pamo acid-type compound means a compound obtained by the reaction of the above mentioned pamo acid-type compound with a metal-providing agent. The chemical structure is not clearly understood, but it is believed that as a metal complex or a metal salt, the carboxyl group and/or the hydroxyl group of the pamo acid-type compound and the metal atom are bonded in various bonding states by e.g. ionic bond, coordinate bond or covalent bond.

The metal may, for example, be Ti, Zr, Si, Fe, Zn, Cu, Al, Cr, Ni or Co. For the synthesis, various conventional methods may be employed. For example, when metal is Ti, Zr or Si, the pamo acid-type compound and the metal-providing agent may be reacted in a solvent such as toluene or dioxane under heating to a temperature of from 50 120° C. As specific examples of the metal-providing agent, tetraisopropoxytitanium, tetra-n-butoxytitanium, tetraisopropoxyzirconium and tetraisopropoxysilane, may be mentioned. Further, in a case where the metal is Fe, Zn, Cu, Al, Cr, Ni or Co, the compound can be obtained by reacting the reactants in an aqueous solution. The metal-providing agent may, for example, be iron sulfate, zinc chloride, copper sulfate, aluminum chloride, chromium sulfate, nickel chloride or cobalt chloride. Such a metal compound of a pamo acid-type compound has a merit that it is excellent in the thermal stability in addition to its excellent chargeability.

Specific examples of preferred compounds will be given, but useful compounds are not limited to such specific examples.

Specific Compounds

(31) A 2:1 compound of 4,4'-methylenebis(3-hydroxy-2-naphthalenecarboxylic acid) and Ti
(32) A 2:1 compound of 4,4'-methylenebis(3-hydroxy-2-naphthalenecarboxylic acid and Zr
(33) A 2:1 compound of 4,4'-methylenebis(3-hydroxy-2-naphthalenecarboxylic acid and Si
(34) A 2:1 compound of 4,4'-methylenebis(3-hydroxy-7-methyl-2-naphthalenecarboxylic acid) and Ti
(35) A 2:1 compound of 4,4'-methylenebis(3-hydroxy-7-methyl-2-naphthalenecarboxylic acid) and Si
(36) A 2:1 compound of 4,4'-methylenebis(7-ethyl-3-hydroxy-2-naphthalenecarboxylic acid) and Ti
(37) A 2:1 compound of 4,4'-methylenebis(3-hydroxy-7-porpyl-2-naphthalenecarboxylic acid) and Zr
(38) A 2:1 compound of 4,4 -methylenebis(7-butyl-3-hydroxy-2-naphthalenecarboxylic acid) and Si
(39) A 2:1 compound of 4,4'-methylenebis(7-amino-3-hydroxy-2-naphthalenecarboxylic acid) and Ti
(40) A 2:1 compound of 4,4 -methylenebis(7-amino-3-hydroxy-2-naphthalenecarboxylic acid) and Zr
(41) A 2:1 compound of 4,4'-methylenebis(3-hydroxy-7-methoxy-2-naphthalenecarboxylic acid) and Ti
(42) A 2:1 compound of 4,4'-methylenebis(3-hydroxy-7-methoxy-2-naphthalenecarboxylic acid) and Zr
(43) A 2:1 compound of 4,4 -methylenebis(7-ethoxy-3-hydroxy- 2-naphthalenecarboxylic acid) and Si
(44) A 1:1 compound of 4,4'-methylenebis(3-hydroxy-2-naphthalenecarboxylic acid) and Fe
(45) A 1:1 compound of 4,4'-methylenebis(3-hydroxy-7-methyl-2-naphthalenecarboxylic acid) and Fe
(46) A 1:1 compound of 4,4'-methylenebis(3-hydroxy-2-naphthalenecarboxylic acid) and Zn
(47) A 1:1 compound of 4,4'-methylenebis(7-ethyl-3-hydroxy-2-naphthalenecarboxylic acid) and Zn
(48) A 1:1 compound of 4,4'-methylenebis(3-hydroxyl-2-naphthalenecarboxylic acid) and Cu
(49) A 1:1 compound of 4,4'-methylenebis(7-butyl-3-hydroxy-2-naphthalenecarboxylic acid) and Cu
(50) A 1:1 compound of 4,4'-methylenebis(3 hydroxy-2-naphthalenecarboxylic acid) and Al
(51) A 1:1 compound of 4,4'-methylenebis(7-amino-3-hydroxy-2-naphthalenecarboxylic acid) and Al
(52) A 1:1 compound of 4,4'-methylenebis(3-hydroxy-2-naphthalenecarboxylic acid) and Cr
(53) A 1:1 compound of 4,4'-methylenebis(3-hydroxy-7-methoxy-2-naphthalenecarboxylic acid) and Cr
(54) A 1:1 compound of 4,4'-methylenebis(3 hydroxy-2-naphthalenecarboxylic acid) and Ni
(55) A 1:1 compound of 4,4'-methylenebis(3-hydroxy-7-methyl-2-naphthalenecarboxylic acid) and Ni
(56) A 1:1 compound of 4,4'-methylenebis(3-hydroxy-2-naphthalenecarboxylic acid) and Co
(57) A 1:1 compound of 4,4'-methylenebis(3-hydroxy-7-propyl-2-naphthalenecarboxylic acid) and Co
(58) A 2:1 compound of 4,4'-methylenebis(1-hydroxy-2-naphthalenecarboxylic acid) and Ti
(59) A 1:1 compound of 4,4'-methylenebis(1-hydroxy-2-naphthalenecarboxylic acid) and Zn
(60) A 1:1 compound of 4,4'-methylenebis(1-hydroxy-2-naphthalenecarboxylic acid) and Fe
(61) A 1:1 compound of 4,4'-methylenebis(1-hydroxy-2-naphthalenecarboxylic acid) and Al
(62) A 1:1 compound of 4,4'-methylenebis(2-hydroxy-1-naphthalenecarboxylic acid) and Ti
(63) A 1:1 compound of 4,4'-methylenebis(7-ethyl-2-hydroxy-1-naphthalenecarboxylic acid) and Zn
(64) A 1:1 compound of 3,3'-methylenebis(2-hydroxy 1-naphthalenecarboxylic acid) and Cu
(65) A 1:1 compound of 3,3'-methylenebis(2-hydroxy-1-naphthalenecarboxylic acid) and Ni
(66) A 1:1 compound of 3,3'-methylenebis(2-hydroxy-1-naphthalenecarboxylic acid) and Al For the toner of the present invention, the hydroxycarboxylic acid compound, the bishydroxycarboxylic acid compound and the metal compound of a pamo acid-type compound may be used in combination, and such compounds may be used in combination with other known charge-imparting agents, such combined use being preferred. It is particularly preferred to use them in combination with a metal-containing dye or with a metal compound of an aromatic hydroxycarboxylic acid which may have a substituent. The compounds of the present invention have very high charge stability, and a synergistic effect may be obtained by such a combination with other charge-imparting agents which lack in charge stability by themselves.

As the metal-containing azo dye, Bontron S-32, S-34 or S-37 manufactured by Orient Chemical Industries Co. Ltd., Spironblack TRH manufactured by Hodogaya Chemical Co. Ltd., or Protoner CCA7 manufactured by ICI Co. Ltd., which is used usually as a negative charge-imparting agent, may be mentioned. As the metal compound of an organic oxycarboxylic acid which may have a substituent, a compound having a metal such as Cr, Co, Ni, Cu, Zn or Al bonded to salicylic acid or a salicylic acid derivative, e.g. Bontron E-81, E-84 or E-88, may be mentioned. However, the metal-containing azo dye and the metal compound of an aromatic oxycarboxylic acid are not limited to such specific examples.

As a method for incorporating the hydroxycarboxylic acid, the bishydroxycarboxylic acid or the metal compound of a pamo acid-type compound and other charge-controlling agents to the toner of the present invention, it is possible to employ either an internal addition method wherein they are added and mixed together with a resin to the toner, or an external addition method wherein they are added and mixed to toner particles. The internal addition method is more common and preferred. They will be contained in the toner in a uniformly mixed state or in a dispersed state.

The content of the hydroxycarboxylic acid compound, the bishydroxycarboxylic acid compound or the metal compound of a pamo acid-type compound in the toner of the present invention, is preferably from 0.1 to 20 parts by weight, more preferably from 0.5 to 15 parts by weight, per 100 parts by weight of the resin. If the content is too small, the effects for improving the chargeability will not be improved. On the other hand, if the content is excessive, the quality of the toner will be low, such being undesirable.

In a case where the above compound and a metal-containing azo dye or a metal compound of an aromatic oxycarboxylic acid which may have a substituent, are incorporated as charge-imparting agents, A+B or A+C in the binder resin is preferably from 0.1 to 10% by weight (hereinafter referred to simply as %), more preferably from 0.5 to 5%, where A is the hydroxycarboxylic acid compound, the bishydroxycarboxylic acid compound or the metal compound of a pamo acid-type compound, B is the metal-containing azo dye, and C is the metal compound of an aromatic oxycarboxylic acid which may have a substituent. If A+B or A+C is too small, it becomes difficult to control the static charge, and if it is too large, the charge stability becomes poor. The ratio of B or C to A is preferably from 1 : 0.1 to 1 : 10, more preferably from 1 : 0.1 to 1 : 5.

The resin to be incorporated to the toner of the present invention may be selected from a wide range including known resins. For example, it may be a styrene-type resin (a homopolymer or copolymer containing styrene or a styrene-substituted compound) such as polystyrene, chloropolystyrene, poly-α-methylstyrene, a styrene-chlorostyrene copolymer, a styrene-propylene copolymer, a styrene butadiene copolymer, a styrene-vinyl chloride copolymer, a styrene-vinyl acetate copolymer, a styrene-maleic acid copolymer, a styrene-acrylate copolymer (such as a styrene-methyl acrylate copolymer, a styrene-ethyl acryalte copolymer, a styrene-butyl acrylate copolymer, a styrene-octyl acrylate copolymer or a styrene-phenyl acrylate copolymer), a styrene-methacrylate copolymer (such as a styrene-methyl methacrylate copolymer, a styrene-ethyl methacrylate copolymer, a styrene-butyl methacrylate copolymer or a styrene-phenyl methacryalte copolymer), a styrene-methyl α-chloroacrylate copolymer, or a styrene-acrylonitrile-acrylate copolymer, a vinyl chloride resin, a rosin-modified maleic acid resin, a phenol resin, an epoxy resin, a polyester resin, a low molecular weight polyethylene, a low molecular weight polypropylene, an ionomer resin, a polyurethane resin, a silicone resin, a ketone resin, an ethylene-ethyl acrylate copolymer, a xylene resin or a polyvinyl butyral resin. As a particularly preferred resin to be used in the present invention, a styrene-type resin (such as a styrene-acrylate copolymer or a styrene-methacrylate copolymer resin), a saturated or unsaturated polyester resin, or an epoxy resin may be mentioned.

The above resins may be used alone or in combination as a mixture of two or more of them.

The colorant to be incorporated to the toner of the present invention may be selected within a wide range including known colorants. For example, it may be carbonblack, lamp black, iron black, ultramarine blue, a Nigrosine dye, aniline blue, phthalocyanine blue, phthalocyanine green, hansa yellow, chrome yellow, rose bengale, a triarylmethane-type dye, a monoazo-type dye or a disazo-type pigment. The content of the colorant is preferably from 3 to 20 parts by weight per 100 parts by weight of the resin.

Further, to the toner of the present invention, other conventional additives such as conductors, semiconductors or ferrodielectrics such as solid electrolytes, polymer electrolytes, charge transfer complexes or metal oxides such as tin oxide, and magnetic substances, may be added to control the electrical characteristics of the toner. Further, to the toner, various plasticizers such as low molecular weight olefin polymers, or assisting agents such as releasing agents, may be added for the purpose of controlling the thermal properties or physical properties.

Further, it is possible to improve the flowability and anticoagulating properties of the toner by adding fine powder of e.g. $TiO_2$, $Al_2O_3$ or $SiO_2$ to toner particles so that the surface of toner particles is coated with such a flowability-imparting agent.

The fine silica powder may be selected from a wide range including known silica powders such as R972, R974 and R812, manufactured by Nippon Aerosil Co., Ltd. and Nip Seal SS50 and SS20, manufactured by Nippon Silica Kogyo K.K.

The amount of the fine silica powder to be added, varies depending upon the average particle size of the classified toner and the average particle size and the hydrophobic degree of the fine silica powder to be added, but it is preferably from 0.01 to 1.0% by weight, more preferably from 0.1 to 0.7% by weight, to the toner.

For the preparation of the toner of the present invention, various methods for preparing toners which have been used, may be employed. For example, the following method may be mentioned as a common method for the preparation. Firstly, a resin, a colorant, a charge-imparting agent, etc. may be uniformly dispersed by means of e.g. a ball mill, a V-type mixer, an S-type mixer or a Henschel mixer. Then, the dispersion is melt-kneaded by means of e.g. a double-arm kneader, a pressure kneader, an extruder or a roll mill The kneaded product is them pulverized by a pulverizer such as a hammer mill, a cutter mill, a jet mill or a ball mill. The powder thus obtained, is further classified by e.g. a wind force classifier. To the classified toner, fine silica powder or the like is added by a Henschel mixer or a super mixer.

The toner thus obtained may be mixed with a carrier to form a two-component developer. It is also useful for a capsulated toner or a polymer toner, and for a magnetic or non-magnetic one-component developer.

The average particle size of the toner is preferably from 5 to 20 μm. As the carrier to be mixed with the toner of the present invention to form a developer, it is possible to employ conventional magnetic materials such as carriers of iron powder type, ferrite type or magnetite type or such magnetic materials having a resin coating on their surface, or magnetic resin carriers.

As the coating resin for the resin-coating carriers, it is possible to employ commonly known styrene resins, acrylic resins, styreneacrylic copolymer resins, silicone resins, modified silicone resins or fluorine resins. However, the coating resin is not limited to such specific examples.

The average particle size of the carrier is not particularly limited, but is usually preferably from 10 to 200 μm. Such a carrier is used preferably in an amount of from 5 to 100. parts by weight per part by weight of the toner.

The electrostatic image-developing toner of the present invention has high chargeability and stability and thus provides a constant image density for continuous copying or printing, and it is a toner of high quality which does not brings about image-staining or contamination in the copying machine.

Now, the present invention will be described in further detail with reference to Examples. However, it should be understood that the present invention is by no means restricted by such specific Examples.

In the following Examples, "parts" means "parts by weight".

EXAMPLE 1

| | |
|---|---|
| Styrene resin (SBM-600, manufactured by Sanyo Kasei K.K.) | 100 parts |
| Carbonblack (#44, manufactured by Mitsubishi Kasei Corporation) | 10 parts |
| Compound (1) | 1 part |

The above materials were blended, kneaded, pulverized and classified to obtain a black toner having an average particle size of 11 μm.

Five parts of this toner and 100 parts of a fluorine resin-coating carrier having an average particle size of about 100 μm were mixed and stirred to obtain a developer. Then, using this developer, a copy was taken by a copying machine employing selenium as a photoreceptor, whereby a clear copy was obtained.

COMPARATIVE EXAMPLE 1

The operation was conducted in the same manner as in Example 1 except that, as a charge-controlling agent, 1 part of a 5,5'-methylene-di-salicylic acid compound was used instead of Compound (1), whereby the obtained image was of low quality with respect to the image density. This is believed to be due to the decomposition of the compound during the preparation of the toner.

EXAMPLES 2 TO 4 AND 6 TO 13

The operation was conducted in the same manner as in Example 1 except that the type and amount of the compound used as the charge-controlling agent were changed as shown in Table 1, whereby clear copies were obtained as in the case of Example 1.

TABLE 1

| | Compound No. | Amount (parts) |
|---|---|---|
| Example 2 | (4) | 2 |
| Example 3 | (5) | 1 |
| Example 4 | (6) | 2 |
| Example 6 | (12) | 3 |
| Example 7 | (14) | 1 |
| Example 8 | (17) | 2 |
| Example 9 | (18) | 2 |
| Example 10 | (19) | 2 |
| Example 11 | (22) | 4 |
| Example 12 | (24) | 3 |
| Example 13 | (26) | 4 |

EXAMPLE 5

The operation was conducted in the same manner as in Example 1 except that 4 parts of quinacridone pigment was used instead of carbonblack as the colorant and 3 parts of Compound (1) was used, whereby a clear copy was obtained as in the case of Example 1.

EXAMPLE 14

The operation was conducted in the same manner as in Example 1 except that 4 parts of quinacridone pigment was used instead of carbonblack as the colorant, and 3 parts of Compound (14) was used, whereby a clear copy was obtained as in the case of Example 1.

EXAMPLE 15

| | |
|---|---|
| Styrene-acrylate resin (styrene-butyl acrylate) | 100 parts |
| Carbonblack (MA-8, manufactured by Mitsubishi Kasei Corporation) | 8 parts |
| Compound (1) | 1 part |
| Metal containing azo dye (S-34, manufactured by Orient Chemical Industries Co., Ltd.) | 1 part |

The above materials were blended, kneaded, pulverized and classified to obtain a black toner having an average particle size of 11 μm.

To 100 parts of this black toner, 0.2 part of fine silica powder (R972, manufactured by Nippon Aerosil Co., Ltd.) was externally added by a Henschel mixer. Four parts of this toner and 100 parts of a magnetite carrier coated with an acrylate resin having an average particle size of 100 μm were mixed to obtain a developer, and a test for copying 10,000 sheets was carried out by means of a modified copying machine capable of copying 400 sheets per minute employing an organic photoconductor as a photoreceptor.

The supplemental toner used for the copying test was a toner having the same composition as the toner used for the above developer. As a result of the copying test, the image density of the copy was high and the charge of the developer was stable even after copying 10,000 sheets.

EXAMPLES 16, 17 AND 18 AND COMPARATIVE EXAMPLES 2, 3 AND 4

The operation was conducted in the same manner as in Example 15 except that the amounts of Compound (1), the metal-containing azo dye and the metal compound of an aromatic oxycarboxylic acid which may have a substituent (E-84, manufactured by Orient Chemical Industries Co., Ltd.) were changed. The results are shown in Table 2 together with the results of Example 15. The image density was measured by Macbeth Densitometer RD917 and evaluated in accordance with the following evaluation standards:

| | |
|---|---|
| Image density of at least 1.35: | ◎ |
| Image density of from 1.35 to 1.25: | ○ |
| Image density of from 1.25 to 1.00: | Δ |
| Image density of less than 1.00: | x |

The charge was measured by means of a blow off powder charge-measuring apparatus, manufactured by TOSHIBA CHEMICAL, and the charge stability was determined by evaluating the deviation from the initial level in accordance with the following standards:

| | |
|---|---|
| ±5 μC/g: | ◎ |
| ±10 μC/g: | ○ |
| ±15 μC/g: | Δ |
| ±10 μC/g: | x |

TABLE 2

| | Compound (1) | Metal-containing azo dye S-34 | Metal compound of aromatic oxycarboxylic acid E-34 | Image density: Initial | Image density: After copying 10,000 sheets | Charge stability |
|---|---|---|---|---|---|---|
| Example 15 | 1 part | 1 part | — | ◎ | ○ | ○ |
| Example 16 | 2 parts | 1 part | — | ◎ | ◎ | ◎ |
| Example 17 | 0.5 parts | 1 part | — | ◎ | ○ | ○ |
| Example 18 | 2 parts | — | 1 part | ◎ | ◎ | ◎ |
| Comparative Example 2 | — | 1 part | — | ◎ | X | X |
| Comparative Example 3 | — | 2 parts | — | ◎ | Δ | Δ |
| Comparative Example 4 | — | — | 1 part | ◎ | X | X |

EXAMPLE 19

The operation was conducted in the same manner as in Example 1 except that one part of Compound (14) was used instead of Compound (1), whereby, as a result of the copying test, the image density was high and the charge of the developer was stable even after copying 10,000 sheets.

EXAMPLES 20, 21 AND 22

The operation was conducted in the same manner as in Example 19 except that the amounts of Compound (14), the metal-containing dye and the metal compound of an aromatic oxycarboxylic acid which may have a substituent (E-84, manufactured by Orient Chemical Industries Co., Ltd.) were changed. The results are shown in Table 3 together with the results of Example 19.

TABLE 3

| | Compound (1) | Metal-containing azo dye S-34 | Metal compound of aromatic oxycarboxylic acid E-34 | Image density: Initial | Image density: After copying 10,000 sheets | Charge stability |
|---|---|---|---|---|---|---|
| Example 19 | 1 part | 1 part | — | ◎ | ○ | ○ |
| Example 20 | 2 parts | 1 part | — | ◎ | ◎ | ◎ |
| Example 21 | 0.5 parts | 1 part | — | ○ | ○ | ○ |
| Example 22 | 2 parts | — | 1 part | ◎ | ◎ | ◎ |

EXAMPLE 23

| | |
|---|---|
| Styrene resin (SMB-600, manufactured by Sanyo Kasei K.K.) | 100 parts |
| Carbonblack (#44, manuractured by Mitsubishi Kasei Corporation) | 10 parts |
| Compound (31) | 1 part |

The above materials were blended, kneaded, pulverized and classified to obtain a black toner having an average particle size of 11 μm.

Five parts of this toner and 100 parts of a ferrite carrier having an average particle size of about 100 μm were mixed and stirred to obtain a developer. The charge of the toner as measured by a blow off method was −25.0 μC/g. Then, using this developer, 1,000 sheets of A4 size paper were continuously copied by a copying machine employing selenium as a photoreceptor, whereby clear copies were constantly obtained.

EXAMPLES 24 TO 33

The operation was conducted in the same manner as in Example 23 except that the type and the amount of the compound as the charge-controlling agent were changed as shown in Table 4, whereby clear copies were obtained as in the case of Example 23.

TABLE 4

| | Compound No. | Amount (parts) |
|---|---|---|
| Example 24 | (32) | 2 |
| Example 25 | (34) | 1 |
| Example 26 | (37) | 3 |
| Example 27 | (40) | 2 |
| Example 28 | (41) | 2 |
| Example 29 | (44) | 3 |
| Example 30 | (46) | 2 |
| Example 31 | (50) | 3 |
| Example 32 | (60) | 3 |
| Example 33 | (63) | 4 |

COMPARATIVE EXAMPLE 5

The operation was conducted in the same manner as in Example 23 except that Compound (31) was not used as a charge-controlling agent, whereby as the number of copied sheets increased, the density of the image became low, and the resulting image tended to be of low quality.

We claim:

1. An electrostatic image-developing toner comprising at least a resin and a colorant, which contains at least one compound selected from the group consisting of a hydroxyanthracenecarboxylic acid compound, a bishydroxynaphthalenecarboxylic acid compound, a bishydroxyanthracenecarboxylic acid compound, and a metal compound of a compound having hydroxynaphthalenecarboxylic acids dimerized by means of a methylene chain.

2. The electrostatic image-developing toner according to claim 1, wherein the hydroxyanthracenecarboxylic acid compounded is represented by the following formula (II):

(II)

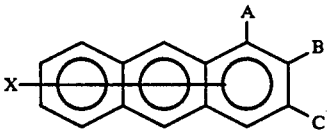

wherein at least one of A, B and C is a hydroxyl group, at least one of them is a carboxyl group and the rest is a hydrogen atom, and X is a hydrogen atom, an alkyl group, an amino group or an alkoxy group.

3. The electrostatic image-developing toner according to claim 1, wherein the bishydroxynaphthalenecarboxylic acid compound is represented by the following formula (III) or (IV):

(III)

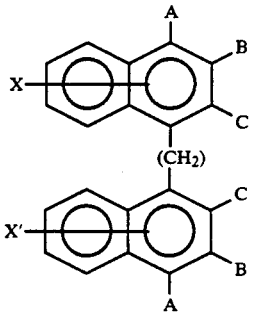

(IV)

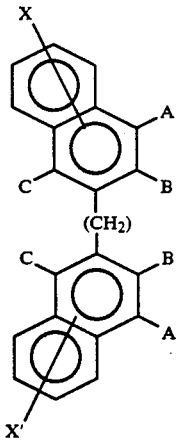

wherein at least one of A, B and C is a hydroxyl group, at least one of them is a carboxyl group and the rest is a hydrogen atom, n is an integer of from 1 to 3, and each of X and X' is a hydrogen atom, an alkyl group, an amino group or an alkoxy group.

4. The electrostatic image-developing toner according to claim 1, wherein the bishydroxyanthracenecarboxylic acid compound is represented by the following formula (V) or (VI):

(V)

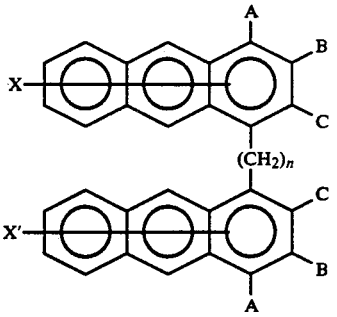

(VI)

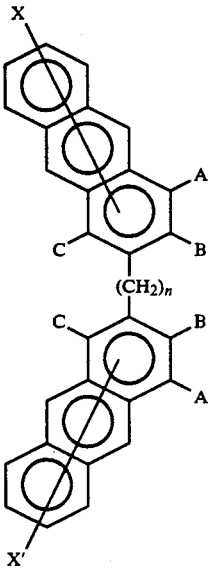

wherein at least one of A, B and C is a hydroxyl group, at least one of them is a carboxyl group and the rest is a hydrogen atom, n is an integer of from 1 to 3, and each of X and X' is a hydrogen atom, an alkyl group, an amino group or an alkoxy group.

5. The electrostatic image-developing toner according to claim 1, wherein the metal compound of a compound having hydroxynaphthalenecarboxylic acids dimerized by means of a methylene chain is a compound obtained by reacting a compound of the following formula (VII) or (VIII) with a metal-providing agent:

(VII)

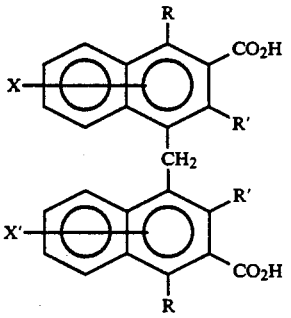

-continued (VIII)

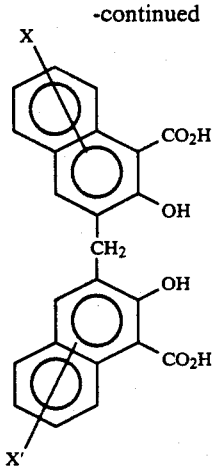

wherein one of R and $R^1$ is a hydroxyl group and the other is a hydrogen atom and both R and $R^1$ are not simultaneously hydroxyl groups or hydrogen atoms, and each of X and $X^1$ is a hydrogen atom, an alkyl group, an amino group or an alkoxy group.

6. The electrostatic image-developing toner according to claim 1 or 5, wherein the metal of the metal compound of a compound having hydroxynaphthalenecarboxylic acids dimerized by means of a methylene chain is selected from the group consisting of Ti, Zr, Si, Fe, Zn, Cu, Al, Cr, Ni and Co.

7. The electrostatic image-developing toner according to claim 1, wherein the compound selected from the group consisting of a hydroxyanthracenecarboxylic acid compound, a bishydroxynaphthalenecarboxylic acid compound, a bishydroxyanthracenecarboxylic acid compound, and a metal compound of a compound having hydroxynaphthalenecarboxylic acids dimerized by means of a methylene chain, is in an amount of from 0.1 to 20 parts by weight per 100 parts by weight of the resin.

8. The electrostatic image-developing toner according to claim 1, which further contains a positive charge-imparting agent.

9. The electrostatic image-developing toner according to claim 1, which further contains a negative charge-imparting agent.

10. The electrostatic image-developing toner according to claim 9, wherein the negative charge-imparting agent is a metal-containing azo dye or a metal compound of an aromatic oxycarboxylic acid which may have a substituent.

11. The electrostatic image-developing toner according to claim 9, wherein the negative charge-imparting agent is in an amount of from 0.1 to 10 parts by weight per part by weight of the compound selected from the group consisting of bishydroxynaphthalenecarboxylic acid compound, a bishydroxyanthracenecarboxylic acid compound, and a metal compound of a compound having hydroxynaphthalenecarboxylic acids dimerized by means of a methylene chain.

12. The electrostatic image-developing toner according to claim 1, wherein the resin is selected from the group consisting of a styrene resin, a saturated or unsaturated polyester resin and an epoxy resin.

13. A developer for electrostatic image-development, which comprises a toner and a carrier, wherein the toner comprises at least a resin and a colorant, and contains at least one compound selected from the group consisting of a hydroxyanthracenecarboxylic acid compound, a bishydroxynaphthalenecarboxylic acid compound, a bishydroxyanthracenecarboxylic acid compound, and a metal compound of a compound having hydroxynaphthalenecarboxylic acids dimerized by means of a methylene chain.

* * * * *